United States Patent [19]

Shay

[11] Patent Number: 4,585,358

[45] Date of Patent: Apr. 29, 1986

[54] SHAKEABLE SHUTOFF ALARM CLOCK

[76] Inventor: Jonathan Shay, 141 Cedar St., Newton, Mass. 02159

[21] Appl. No.: 613,295

[22] Filed: May 23, 1984

[51] Int. Cl.[4] ..... G04B 23/00

[52] U.S. Cl. ..... 368/262; 368/73

[58] Field of Search ..... 368/262, 263, 72, 73, 368/244, 257

[56] References Cited

U.S. PATENT DOCUMENTS

| | | | |
|---|---|---|---|
| 1,381,225 | 6/1921 | Pfefer | 368/262 |
| 1,410,409 | 3/1922 | Maier | 368/262 |
| 3,604,200 | 9/1971 | Sapper | 368/262 |
| 3,797,223 | 3/1974 | Oliveri | 368/262 |
| 4,218,875 | 8/1980 | Rothman | 368/262 |
| 4,352,170 | 9/1982 | Jetter | 368/262 |

*Primary Examiner*—Bernard Roskoski

*Attorney, Agent, or Firm*—Donald W. Meeker

[57] ABSTRACT

Within an easily hand gripped alarm clock, preferably of a soft sperical exterior shape, a shakeable switching means. A first standard alarm is silenced by laterally shaking the clock, and a second moaning sound is emitted after the lateral shaking. A grimacing face imprinted on the round clock face enhances the cathartic effect. The laterally shakeable switch is an enclosed container of mercury with an alarm contact in the central lower bowl and an elevated surrounding trough sloping into the bowl through a channel containing electrical contacts for the second moan sound. The mercury makes and breaks the contacts. An alternative laterally shakeable switch provides an electrically conductive sphere within an enclosed container having a bottom indentation with alarm contacts and an upwardly sloping surrounding spiral trough with parallel track contacts for the moan sound in the bottom of the trough. The sphere connects either sound producing contact pair. Another alternate laterally shakeable switch provides a conductive pendulum contacting a conductive spring in a stationary position completing a circuit to a first standard alarm. Laterally shaking the pendulum moves it away from the spring into contact with an electrically conductive surrounding truncated cone to make a connection to a second sound-producing circuit. The pendulum makes and breaks the connections. A timer delay may be added so that the second sound-producing circuit remains activated for a brief time interval after the pendulum is no longer in contact with the cone.

16 Claims, 9 Drawing Figures

SHAKEABLE SHUTOFF ALARM CLOCK

BACKGROUND OF THE INVENTION

1. Technical Field

The present invention relates to alarms for clocks having audible signal devices and in particular to controls for alarm signals which respond to motion of the clock.

2. Background Art

Most alarm clocks provide an irritating sound to awaken a sleeper, the more irritating the more effective. But this same effectiveness, while causing the person to be aroused from a sleeping state to waking, also serves to aggravate the person to the extent that very often the disturbed sleeper upon awakening will slam down the switch to shut off the alarm, possibly breaking the switch and leading to further aggravation. One alarm clock (U.S. Pat. No. 4,218,875), which purports to provide a cathartic effect by throwing the sound generating portion of the clock, runs the risk of damaging the clock, objects or even people in the room when such a missile is hurled by a bleary eyed awakened sleeper. Some very old alarms provide noisy objects such as bells falling on the sleeper, again running the risk of injury.

Most alarm clocks provide only a single sound for awakening a person. Although there are various reactivating means to repeat the sound after a delay period, the sound always remains the same.

Most alarm clocks do not require participation or secondary awakening effects to aid in the awakening process but require only that the awakened person mechanically switch off the alarm.

DISCLOSURE OF THE INVENTION

By providing an alarm shut-off switch which requires a rigorous shaking movement of the clock to quiet the alarm, the awakening sleeper is afforded the cathartic pleasure of getting even with the clock for intruding the sleeper, thereby bringing a sense of pleasurable revenge to the awakened person and starting the day with a much more positive attitude without actually breaking or damaging the alarm clock or anyone or anything else in the room, including the sleeper, in any way.

A second moaning sound temporarily activated automatically after the shaking ceases the first alarm provides an additional noise to aid in waking the sleeper, and in a very pleasant manner by bringing a laugh or smile to the awakened individual.

A high level of participation by the awakened sleeper provides a very effective alarm clock: physical participation in shaking the clock to shut off the alarm and emotional participation on three levels including the aggravation by the first alarm, the pleasant revenge of shaking the disturbing clock and the humor of the moaning alarm clock.

Providing a grimacing human face on the face of the alarm clock further adds to the emotional involvement in getting even with the nuisance alarm.

Having a small curved body for the alarm clock facilitates the gripping for better shaking.

A soft exterior surface on the body of the clock enables the user to dig fingers and fingernails into the surface of the clock further satisfying the urge for revenge.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
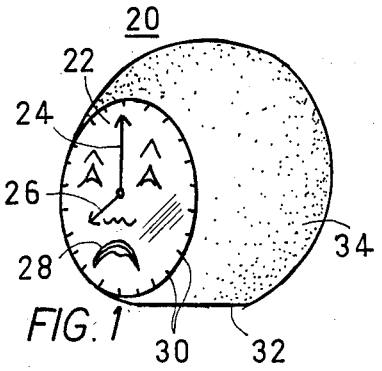
FIG. 1 is a perspective view of the preferred embodiment of the shakeable alarm clock exterior in approximately spherical form.

In FIG. 1 the preferred embodiment of the shakeable alarm clock 20 comprises a substantially spherical body 34 coated with a soft spongy material such as sponge rubber so that the user's fingernails may be dug into the surface as the user grips the clock. The circular face 22 of the clock is provided with the usual minute 24 and hour 26 hands with markings 30 around the periphery for the hours. In addition, the face is imprinted or molded with a grimmacing face 28 for further enhancing the cathartic effect of the alarm clock's shakeability. The clock works may be mechanical or electrical and a digital clock is also possible. The base 32 of the clock is flat for resting on a horizontal surface.

Figure 2:
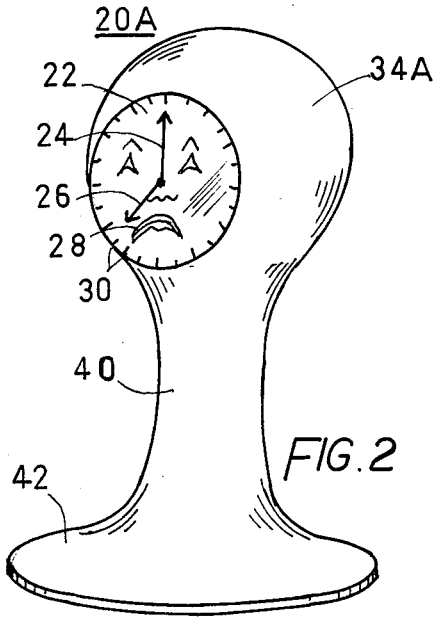
FIG. 2 is a perspective view of an alternate embodiment of the shakeable alarm clock exterior provided with a long neck portion for grasping.

In FIG. 2 an alternate embodiment 20A of the invention provides a substantially spherical body 34A with a very elongated neck 40 extending downwardly from the body for a firm choke-like grasp around the neck of the clock by the user's hand. A broad extending rim 42 at the bottom of the neck provides a substantial base upon which to rest the clock. As in the preferred embodiment the gripping portions of the clock may be coated with a soft spongy material.

Figure 3:
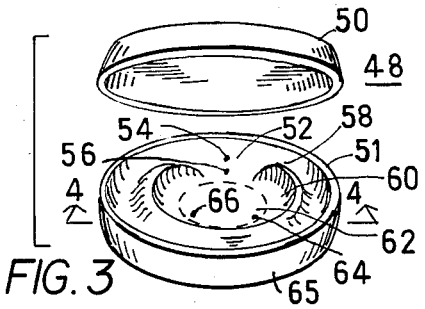
FIG. 3 is a perspective view of the preferred embodiment of the shakeable switch portion of the alarm clock having the top open to reveal the mercury switch inside.
Figure 4:
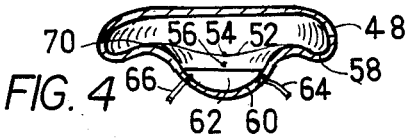
FIG. 4 is a cross-sectional view of the preferred embodiment of the mercury switch just before shaking taken through 4—4 of FIG. 3.
Figure 5:
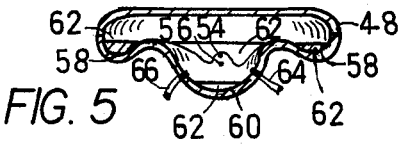
FIG. 5 is a cross-sectional view of the preferred embodiment of the mercury switch just after shaking taken through 4—4 of FIG. 5.
Figure 8:
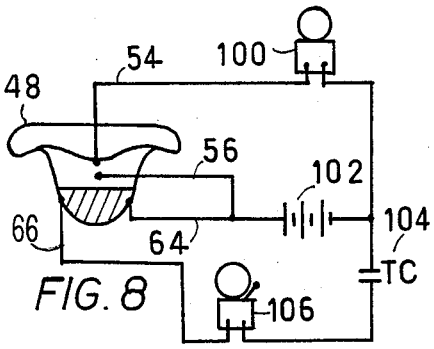
FIG. 8 is a diagrammatic view of the preferred mercury switch connected to the electrical alarm circuit.

In FIGS. 3, 4 and 5 the shakeable mercury switch 48 of the preferred embodiment of the invention is formed from a rigid shell having top 50 and bottom 51 sections which are both fabricated of an electrically non-conductive material such as plastic and are secured together, as by cementing, in usage to form a completely enclosed impermeable vessel. The bottom section comprises a central bowl 60 formed in the vessel and a peripheral trough 58 higher than the bowl, and completely surrounding the bowl around the perimeter of the vessel which trough is separated from the bowl by a ridge 70 higher than the trough except for a channel 52 through the ridge which joins the higher trough 58 to the lower bowl 60. Protruding through the bottom wall of the bowl are two electrical primary alarm contacts 64 and 66, which as seen in FIG. 8, are connected in series with the primary alarm 106, the battery 102 and the time control switch 104 for activating the alarm. The mercury 62 or other electrically conductive liquid in the bowl makes the electrical connection across the contacts 64 and 66, when the timer closes the time controlled switch 104 to set off the alarm. When the clock is shaken the mercury 62 in the bowl 60 is dispersed out into the surrounding trough 58 thereby breaking the connection between the contacts 64 and 66 and shutting off the primary alarm, which deactivates the time controlled switch 104 until the timer reactivates again.

In the channel 52 leading from the continually sloping 58 down into the bowl 60, a second pair of contacts 54 and 56 through the vessel wall protrude in vertical alignment within the channel. As the Mercury flows over the channel contacts 54 and 56 are electrically connected by the mercury to activate a second sounding means 100 in the second circuit, as seen in FIG. 8, with the channel contacts 54 and 56, the battery 102 and the second sounding means 100 all in series. The second sounding source generates a moaning sound while the mercury flows over the channel contacts, until all of the mercury has flowed back into the bowl thereby breaking the connection between the channel contacts and stopping the moaning sound. This moaning sound further adds to the delight in shaking the clock to quiet the alarm, and the humor and satisfaction in the sound further aid in waking the sleeper in a pleasant fashion.

Figure 6:
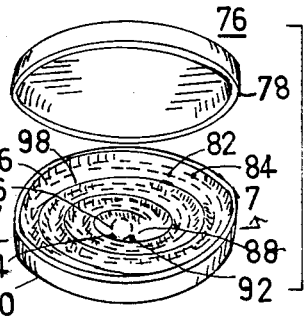
FIG. 6 is a perspective view of an alternate embodiment of the shakeable switch with the top up to reveal a rolling sphere and a ramped spiral track.
Figure 7:
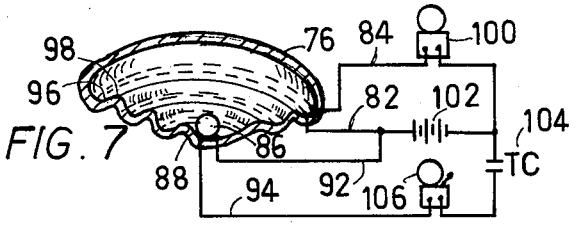
FIG. 7 is a cross-sectional view of the sphere-and-track alternate embodiment of the shakeable switch taken through 7—7 of FIG. 6 with an additional diagram showing the electrical circuit for the alarm connected to the switch.

In FIGS. 6 and 7 an alternate embodiment of the shakeable switch 76 provides a closed rigid container of electrically non-conductive material, such as plastic, with a top 78 and bottom 80 sections secured together, as by cementing. In the bottom section 80 a centrally positioned hemispherical depression 88, at the low point of the bottom, supports an electrically conductive sphere 86 resting within the hemisphere. Electrical primary alarm contacts 92 and 94 protrude through the container into the hemispherical depression 88, wherein the sphere creates an electrical connection between the contacts to sound the primary alarm 106, in FIG. 7, when the time controlled switch 104 has been closed by the alarm timer. Surrounding the hemispherical depression is a ramped spiral trough 96 rising from the hemispherical depression 88 at a constant incline up to the perimeter of the enclosed container or chamber. Along the entire length of the spiral trough along its bottom, which conforms in cross-section to the sphere, run parallel track contacts 82 and 84 (dashed lines) forming an electrical contact between which the sphere makes an electrical connection as long as the sphere is riding in the trough. Shaking the container dislodges the sphere 86 from the hemispherical depression 88 and launches it into the spiral trough 96 at some point. When the connection between the depression contacts 92 and 94 is broken, the primary alarm 106 stops and is not reactivated until the alarm timer closes the time controlled switch 104, with the sphere in the hemispherical depression. When the sphere lands in the spiral trough 96, the conductive sphere makes an electrical connection between the parallel track contacts 82 and 84 to activate a second sound producing means 100 which creates and maintains a moaning sound while the sphere is in the spiral trough.

Figure 9:
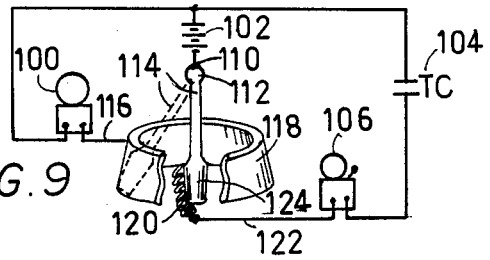
FIG. 9 is a perspective view partially in broken section of another alternate embodiment of the shakeable switch having a pendulum, shown connected to a diagram of the electrical circuit for the alarm.

In FIG. 9 another alternate shakeable switching means comprises an electrcially conductive pendulum 114 with a top contact 110 connecting to a battery 102 which then connects with either a primary alarm 106 circuit having a time controlled switch 104 from the alarm timer or a circuit containing a second sound producing means 100. A spherical top 112 on the pendulum allows the pendulum to maintain contact with the top contact 110 at all times regardless of the swinging action of the pendulum. When the pendulum is hanging down straight with the clock at rest, the weighted end 124 of the pendulum contacts an electrically conductive spring 120 or coil which completes the circit along a conductor 122 to the primary alarm 106. With the pendulum hanging vertically, when the alarm timer closes the time controlled switch 104, the primary alarm 106 is sounded. Shaking the clock moves the pendulum away from the spring 120 breaking the contact and silencing the primary alarm until the alarm timer reactivates it. When the pendulum (dashed lines) contacts a surrounding truncated cone 118 of electrically conductive material a secondary circuit with conductor 116 activates a second sound producing means 100 to produce a moaning sound.

The shakeable alarm clock fabricated with either body configuration and any of the possible shakeable switches produces the same multiple levels of participation effective in waking the sleeper. A standard aggravating alarm first startles the sleeper awake. Then the sleeper has the opportunity to shake the clock vigorously to shut off the alarm with a cathartic sense of revenge, further enhanced by a moaning sound emitted from the clock after shaking coupled with the humorous grimacing face of the clock all adding to the awakening process and helping to start the day with a more pleasant outlook.

It is understood that the preceding description is given merely by way of illustration and not in limitation of the invention and that various modifications may be made thereto without departing from the spirit of the invention as claimed.

I claim:

1. An alarm clock which turns off the alarm by laterally shaking the clock, wherein the shakeable alarm clock comprises:

a time-keeping device with a sound generating alarm means connected by an electric alarm circuit to the time-keeping device;

an adjustable control switching means for activating the alarm circuit when the time-keeping device indicates a changeable preselected time, which control switching means closes a control switch on the alarm circuit upon a signal that the time-keeping device has reached the preselected time, which control switch automatically opens the alarm circuit is broken and remains open until the alarm circuit reactivates again;

a shakeable switching means to break the alarm circuit comprising a moveable conductor means normally positioned to make an electrical connection between two contacts in the alarm circuit, which movable conductor means is easily moved out of position upon laterally shaking the clock to break the alarm circuit connection and which movable conductor means returns to its original position remaking the connection between the contacts in the alarm circuit after the clock is in the next position.

2. The shakeable alarm clock of claim 1 wherein the movable conductor means is drawn back to its original position by the force of gravity acting upon the movable conductor means.

3. The shakeable alarm clock of claim 2 wherein the movable conductor means comprises a quantity of an electrically conductive liquid in a closed vessel secured within the clock, wherein the closed vessel includes an internal bottom central bowl sufficiently large to contain all of the conductive liquid within the bowl and the alarm circuit contacts protrude into the bowl at points below the surface level of the liquid in the bowl so that the conductive liquid makes a connection between the contacts surrounding the bowl, a trough below a top edge of the bowl, which trough slopes downward to at least one channel which leads back into the bowl, so that when the alarm circuit is activated by the timekeeping device, upon laterally shaking the clock, the conductive liquid is displaced out of the bowl into the trough breaking the connection between the bowl contacts until the clock is at rest and the conductive liquid flows back into the bowl through the channel remaking the connection between the bowl contacts.

4. The shakeable alarm clock of claim 3 comprising a second sound-producing circuit, wherein contacts from the second sound-producing circuit protrude into the channel at the point of connection between the trough and the bowl, so that as the conductive liquid flows over the contacts an electrical contact is made between the channel contacts to activate the second sound-producing circuit until all of the liquid has flowed back into the bowl and the channel contact connection is broken.

5. The shakeable alarm clock of claim 3 wherein the conductive liquid is liquid mercury.

6. The shakeable alarm clock of claim 2 wherein the movable conductor means comprises an electrically conductive sphere within an enclosed chamber within the clock, wherein the enclosed chamber includes an internal bottom central indentation which receives the conductive sphere so that the bottom of the sphere conforms to the surface of the indentation and the alarm circuit contacts protrude into the surface of the indentation so that the sphere makes an electrical connection between the alarm circuit contacts when the sphere is resting in the indentation, and a spiral trough leading out of the indentation to form an upwardly sloping spiral ramp from the indentation to the chamber side limits, so that when the alarm circuit is activated by the time-keeping device, the clock must be shaken laterally to knock the sphere out of the indentation and into the ramped spiral trough thereby breaking the connection between the alarm circuit contacts until the sphere rolls back down into the indentation to remake the connection.

7. The shakeable alarm clock of claim 6 wherein the contour of the trough exactly conforms to the sphere within the trough and further comprising a second sound-producing circuit, wherein each of two contacts from the second sound-producing circuit is electrically connected to each of two electrically conductive tracks within the spiral trough for the entire length of the spiral trough, so that the sphere makes an electrical connection between the tracks to activate the second sound-producing circuit for the entire duration of travel of the sphere in the spiral trough until the sphere leaves the trough to rest in the indentation when the electrical connection between the tracks is broken to open the second sound-producing circuit.

8. The shakeable alarm clock of claim 7 wherein the conductive tracks are a pair of parallel conductive wires secured within the spiral trough.

9. The shakeable alarm clock of claim 2 wherein the movable conductor means comprises an electrically conductive pendulum with a spherical top resting in a circular support to allow swinging of the pendulum in any direction, and wherein one of the contacts of the alarm circuit is secured to the top of the pendulum and the other contact is secured to an electrically conductive spring or coil protruding upwardly directly below the pendulum to the extent that the pendulum at rest contacts the spring or coil thereby making an electrical connection between the alarm circuit contacts, so that when the alrm circuit is activated by the time-keeping device, the clock must be shaken laterally to move the pendulum away from the spring or coil and break the connection between the alarm circuit contacts until the pendulum comes to rest back in the central position to remake the connection after the clock is at rest.

10. The shakeable alarm clock of claim 9 wherein the pendulum is surrounded by an electrically conductive hollow truncated cone surface within which cone the pendulum may swing with the pendulum contacting the cone surface at the limit of swing, and further comprising a second sound-producing circuit, wherein a first contact from the second sound-producing circuit is secured to the top of the pendulum and a second contact from the second sound-producing circuit is secured to the cone, so that when the pendulum contacts the cone an electrical connection is made between the second sound-producing contacts to activate the second sound-producing circuit.

11. The shakeable alarm clock of claim 10 wherein the second sound-producing circuit is further provided with a time delay so that the second sound-producing circuit remains activated for a brief time interval after the pendulum is no longer in contact with the cone.

12. The shakeable alarm clock of claim 1 further comprising a second sound-producing circuit which is activated when the movable conductor means breaks the connection between the alarm circuit contacts and makes an electrical connection for the second sound-producing circuit.

13. The shakeable alarm clock of claim 12 further comprising a manual switch to deactivate the second sound-producing circuit.

14. The shakeable alarm clock of claim 1 wherein the exterior body of the alarm clock is formed of a soft resilient material into which the user may dig the user's fingers for a more secure grip and greater tension release.

15. The shakeable alarm clock of claim 1 further comprising a clock face including a reprehensible image on the clock face which further contributes to the user's desire to shake the clock and thereby further assists in waking a sleeping user.

16. The shakeable alarm clock of claim 1 wherein the body of the clock is a smooth curved shape to fit comfortably in the hand of the user so that the user does not lose a grip on the clock while shaking the clock.

* * * * *